United States Patent [19]

Matsubara et al.

[11] Patent Number: 4,854,209

[45] Date of Patent: Aug. 8, 1989

[54] ELECTRONIC MUSICAL INSTRUMENT WITH KEY SCALING USING MULTIPLE SET POINTS

[75] Inventors: Akinori Matsubara; Kenichi Tsutsumi; Youji Kaneko; Takashi Akutsu; Naofumi Tateishi, all of Tokyo, Japan

[73] Assignee: Casio Computer Co., Ltd., Tokyo, Japan

[21] Appl. No.: 200,763

[22] Filed: May 31, 1988

[30] Foreign Application Priority Data

Jun. 4, 1987 [JP] Japan ..... 62-86157
Apr. 28, 1988 [JP] Japan ..... 63-104214

[51] Int. Cl.[4] ..... G10H 1/057; G10H 7/00

[52] U.S. Cl. ..... 84/1.01; 84/1.26; 84/478

[58] Field of Search ..... 84/1.01, 1.03, 1.19–1.23, 84/1.28, 1.27, 1.26, 1.1–1.13, 477 R, 478; 364/723

[56] References Cited

U.S. PATENT DOCUMENTS 4,633,749 1/1987 Fujimori et al. ..... 84/1.01
4,703,680 11/1987 Wachi et al. ..... 84/1.01 X
4,779,505 10/1988 Suzuki ..... 84/1.01 X

FOREIGN PATENT DOCUMENTS 61-172192 8/1986 Japan .

*Primary Examiner*—Stanley J. Witkowski
*Attorney, Agent, or Firm*—Frishauf, Holtz, Goodman & Woodward

[57] ABSTRACT

A key scaling apparatus includes a reference data input device which is operated by a user of an electronic musical instrument to designate at least three different key numbers together with respective key scaling data for those key numbers. When a key number is supplied from a play input device such as a keyboard in the electronic musical instrument, an interpolator computes key scaling data for that key number from the data designated by the reference data input device. The computed key scaling data serve to control a tone parameter such as an envelope level which is then used in a tone generator to develop a tone for that key number. Accordingly, a satisfactory key scaling response is obtained over the entire pitch range of keyboard.

7 Claims, 4 Drawing Sheets

ELECTRONIC MUSICAL INSTRUMENT WITH KEY SCALING USING MULTIPLE SET POINTS

BACKGROUND OF THE INVENTION

The present invention relates to an electronic musical instrument and more particularly to a key scaling apparatus for use in an electronic musical instrument which modifies the characteristic of a tone in accordance with the pitch or key number.

In the art of electronic musical instruments, the technology of key scaling for controlling the characteristic of a tone to depend on the key number was known. Some prior art apparatus employs a memory in the form of ROM storing key scaling data which are not programmable by a user. In operation, both a tone number selected by a timbre select switch and the key number input from a play (performance) input device such as a keyboard is used to specify a key scaling data item and read it from the memory for the control of the tone to be generated. An example is disclosed in the Japanese patent laid open (Kokai) No. 61-172,192. This arrangement is unsatisfactory not only because it requires a large amount of storage for key scaling but also because it inhibits the user from gaining access to desirable scaling data.

In another prior art, a key number which is the center of the key scaling is freely selected by the user and an envelope level sensitivity curve extending from the center of key scaling is user-selectable from a plurality of different curves which are preset in the system (see FIG. 6). In operation, the key number input from a keyboard specifies a point along the selected envelope level sensitivity curve so that the envelope sensitivity data at that point is used to modify the envelope level. Such technology is incorporated in a music synthesizer known as DX7. While this arrangement provides an environment in which the user can select the characteristic of the key scaling, it limits satisfactory key scaling response to those regions around the central key number.

SUMMARY OF THE INVENTION

The primary object of the invention is to provide a key scaling apparatus for use in an electronic musical instrument which is capable of giving a satisfactory key scaling response over the entire pitch range.

Another object of the present invention is to provide a key scaling apparatus for use in an electronic musical instrument which permits the user to select more freely and finely the characteristic of the key scaling.

In order to achieve the above objects, a key scaling apparatus in accordance with the invention for use in an electronic musical instrument employing play input means for supplying a variable key number and tone generator means for forming a tone corresponding to the key number supplied from the play input means comprises reference data input means for designating at least three different key numbers together with key scaling data at the respective designated key numbers and interpolator means for computing key scaling data at the key number supplied from the play input means from the data designated by the reference data input means. The key scaling data computed by the interpolator means is used for tone control means to control the tone generator means.

For preference, the key scaling apparatus may further comprises display means for displaying the key numbers and their corresponding key scaling data as designated by the reference data input means. This will make it easier for the user to set the key scaling.

The play input means may be a keyboard or any other suitable play input device which generates a variable key number, used in an electronic string instrument, wind instrument and so on.

Preferably, the interpolator means may comprise means for selecting two key numbers from the designated key numbers, one being higher than and nearest to the key number supplied from the play input means and the other being lower than and nearest to the supplied key number and means for deriving key scaling data at the supplied key number from the two selected key numbers and their corresponding key scaling data. This will conserve the amount of data to be processed by the interpolator means. However, the interpolator means may comprise, if desired, means for generating a curve (of say polynomial with a degree of N) which best fits the multiple data points designated by the preference data input means, and means for searching for a point along the curve corresponding to the key number supplied from the play input means.

The above means for deriving key scaling data may either linear or non-linear (exponential, for example) interpolate the key scaling data at the key number supplied from the play input means between the two selected reference data points.

The key scaling data computed by the interpolator means may be utilized as a subtrahend from which a tone parameter such as a envelope level is subtracted. In the alternative, it may be utilized as an addend to the envelope level. Or, it may be used as a subtrahend or addend for envelope rate. The envelope may be directed to controlling either the tone volume or tone timbre.

BRIEF DESCRIPTION OF THE DRAWING

The above and the other objects, features and advantages of the invention will become apparent from the following description in connection with the drawing in which.

THE DETAILED DESCRIPTION OF A PREFERRED EMBODIMENT

Figure 1:
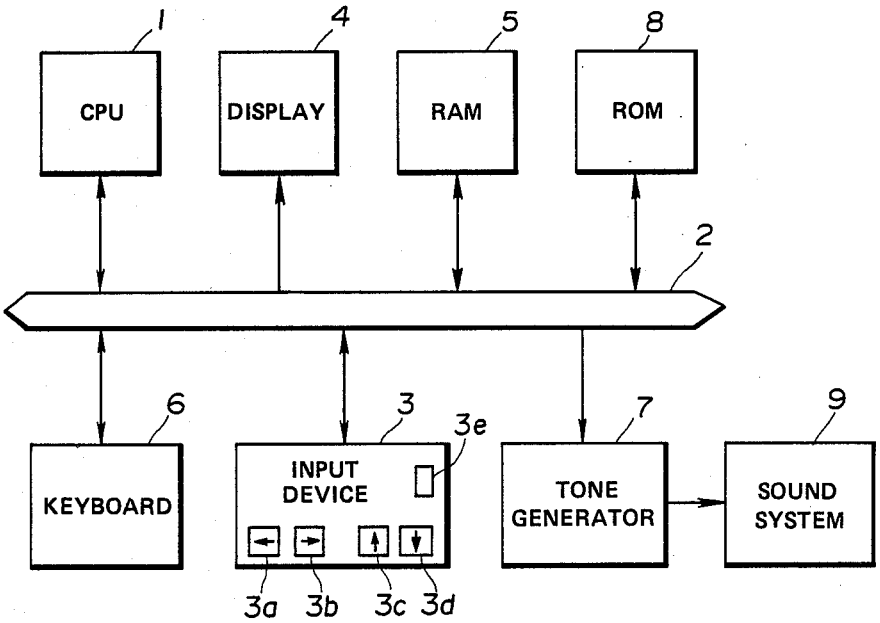
FIG. 1 is a block diagram of the overall arrangement of an electronic musical instrument incorporating the features of the invention.

Referring to FIG. 1, there is showing an overall arrangement of an electronic musical instrument in accordance with the invention. In FIG. 1, a reference numeral 1 indicates a CPU which controls the whole system and is interconnected through a bus 2 to an input device 3 for inputting reference data for key scaling, a display 4 for displaying the reference data, a RAM 5 used as a working memory for CPU 1, a keyboard 6, a tone generator 7 and a ROM 8 for storing a program controlling CPU 1.

The input device 3 comprises a left cursor switch 3*a*, a right cursor switch 3*b*, an up value switch 3*c*, a down value switch 3*d* and a mode select switch 3*e*, as shown, as well as other switches such as tone select switches all required in the electronic musical instrument.

Figure 2:
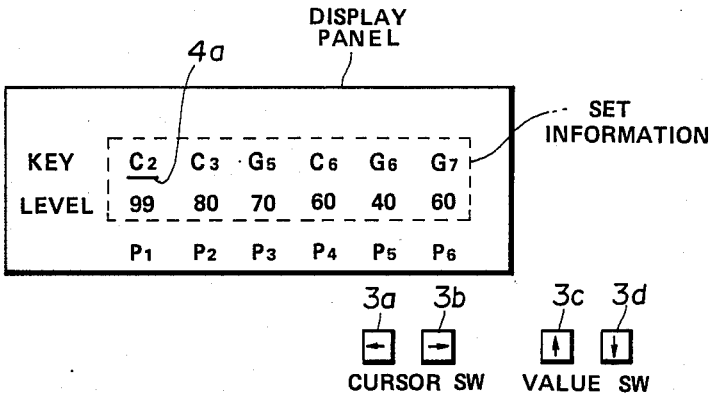
FIG. 2 is a view of a part of an input device and a display.

The display 4 is used to display the set information for key scaling. The display 4 has a display panel (4) as shown in FIG. 2. Indicated at the lower region of the display panel (4) are names of at least three different, here six points along a key scaling profile, that is, P1, P2, P3, P4 and P5. "KEY" and "LEVEL" are indicated on the right side of display panel (4). Indicated in a central region enclosed by a dotted line are the designated key names, here C2, C3, G5, C6, G6 and G7 on the row of "KEY" and numeric values representing the designated key scaling data, here 99, 80, 70, 60, 40 and 60 on the row of "LEVEL". Each key name is displayed in response to the depressing of the corresponding key in the keyboard 6 at a position corresponding to a cursor 4*a* which is moved by left and right cursor switches 3*a* and 3*b* shown below the display panel (4). Each numeric value is displayed at a position corresponding to the cursor 4*a* in accordance with the operation of up and down value keys 3*c* and 3*d* shown right and below the display panel (4).

Figure 3:
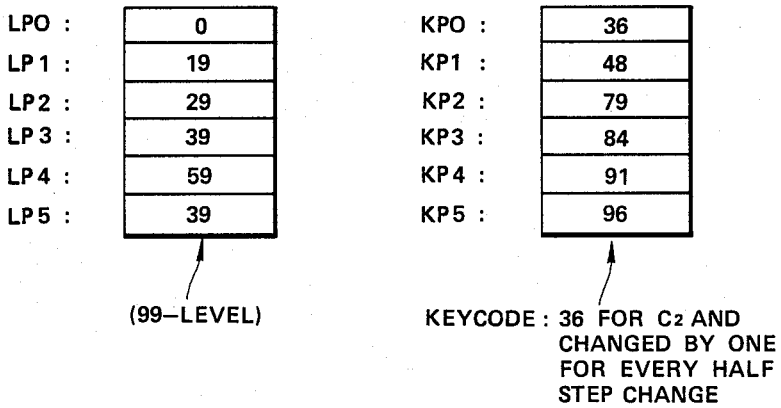
FIG. 3 shows an example of data stored in a RAM for key scaling.

The information displayed in the display 4 as a result of the operations is also stored in RAM 5. The stored data is shown in FIG. 3. More specifically, the points P1, P2, P3, P4, P5 and P6 with respect to "KEY" correspond to key point registers KP0, KP1, KP2, KP3, KP4 and KP5 respectively. The key name data stored in these registers are represented by numeric values which are changed by one for a half tone step with 32 for C2. The points P1, P2, P3, P4, P5 and P6 with respect to "LEVEL" correspond to level point registers LP0, LP1, LP2, LP3, LP4 and LP5 respectively. The level or key scaling data stored in these registers are represented by numeric values each resulting from subtracting the input level in the range of 0 to 99 from 99. Each of the registers LP0 to LP5 and KP0 to KP5 comprises one bite per point.

Referring back to FIG. 1, after the mode select switch 3*e* has been set at a data input mode, CPU 1 detects the data for key scaling as supplied by the operation of switches 3*a* to 3*d* and the keyboard 6 and writes the information into RAM as seen in FIG. 3 as well as controlling the display 4 to provide a visual display thereof as seen in FIG. 2.

After the mode select switch 3*e* is released from the data input mode, CPU 1 detects a key code in response to the depressing of the corresponding key in the keyboard 6. If the key is the same as one of the keys used to set the key scaling information , CPU reads the corresponding level data from RAM 5 as the key scaling data for that key. If the depressed key is between two keys involved in setting the key scaling, CPU reads the data at those two points between which the depressed key is positioned, from RAM 5 and performs an interpolation function using those two point data in accordance with a predetermined formula to derive scaling data for the depressed key.

Thereafter, CPU 1 sends the derived scaling data as well as pitch data corresponding to the depressed key and tone timbre data to the tone generator 7. In response, the tone generator 9 forms a tone signal with its volume or timbre being controlled by the scaling data and passes it to the sound system 9 which then emits a corresponding acoustic signal.

Figure 4:
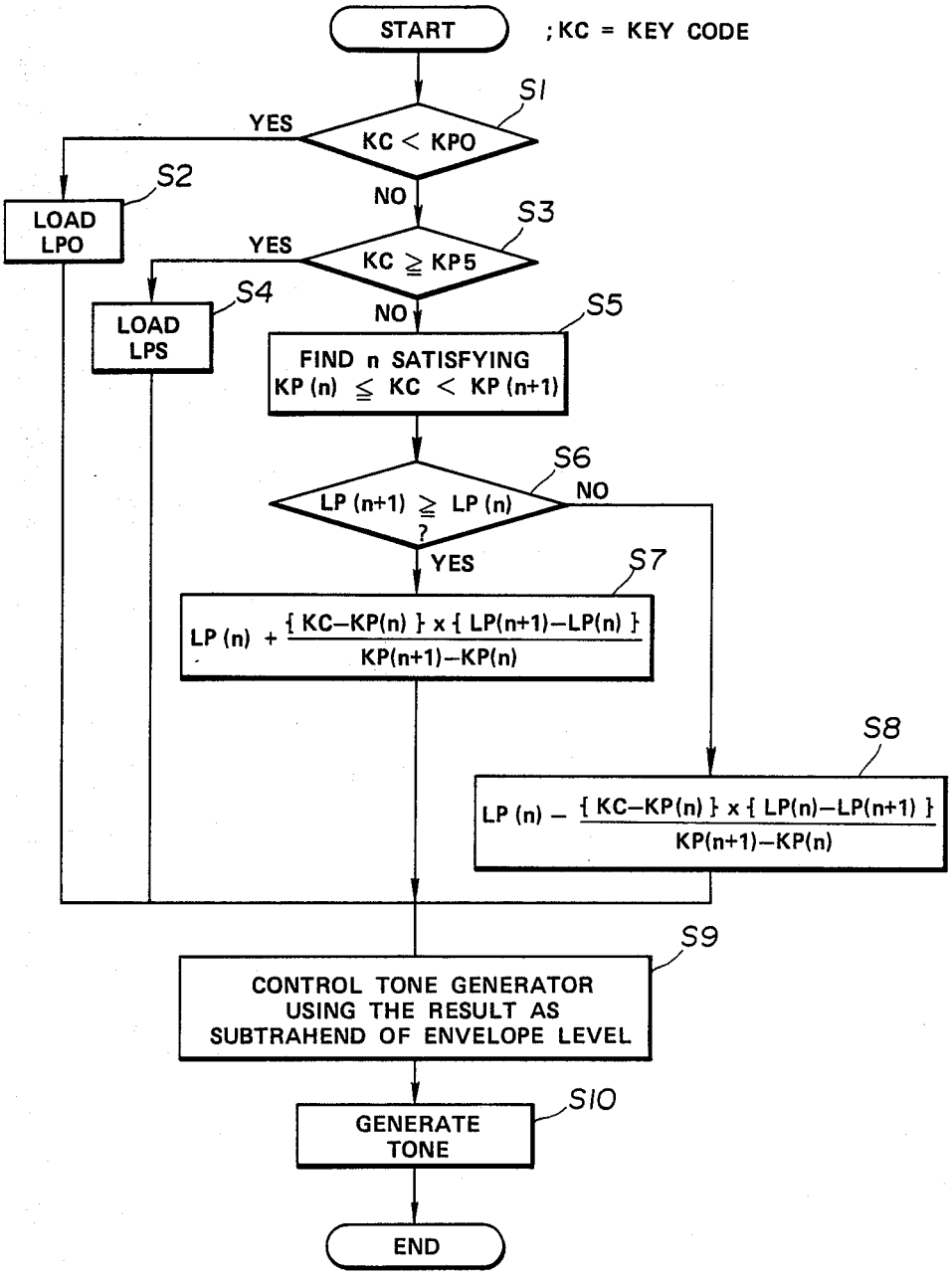
FIG. 4 is a flowchart of the operation of the embodiment in FIG. 1.

Referring now to FIG. 4, there is shown a flowchart of key scaling process. This flow starts upon the depressing of a key. At step S1, CPU 1 checks to see whether the key code KC of the depressed key is less than the lowest set key code stored in the key point register KP0.

If the check at step S1 is affirmative, the content of the level point register LP0 is stored at step S2. This means that for those depressed keys on the lower side of the key indicated by the key point register KP0, the data in the level point register LP0 is used as the key scaling data.

If the check at the step S2 is negative, it is checked at step S3 as to whether the key code for the depressed key is higher than the highest set key code stored in the key point register KP5. If this is the case, the content in the level point register LP5 is loaded at step S4. Thus, the scalling data for any key higher in pitch than the key indicated in the key point register KP5 is given by the data in the level point register LP5.

If the check at step S3 is negative, the point number n which satisfies the relation $KP(n) \leqq KC \leqq KP(n+1)$ is found at step S5 to determine two set points between which the point of the depressed key is located. Then, at step S6, it is checked as to whether $LP(n+1) \leqq LP(n)$, that is, the magnitudes of the key scaling data at the two determined points are compared.

If the check at step S6 is affirmative, CPU 1 computes the following formula at step S7:

$$LP(N)+\{KC-KP(n)\}*\{LP(n+1)-LP(n)\}/\{KP(n+1)-KP(n)\} \quad (1)$$

If the check at step S6 is negative, CPU 1 computes the following formula at step S8:

$$LP(N)+\{KC-KP(n)\}*\{LP(n)-LP(n+1)\}/\{KP(n+1)-KP(n)\} \quad (2)$$

The derived scaling data obtained at any one of steps S2, S4, S7 and S8 is then sent at step S10 to the tone generator 7 as a subtrahend from which an envelope level is subtracted. Further, at step S10 CPU 1 sends the key on instruction to the tone generator 7 to generate a tone signal for the depressed key and then exits from the illustrated flow.

Figure 5:
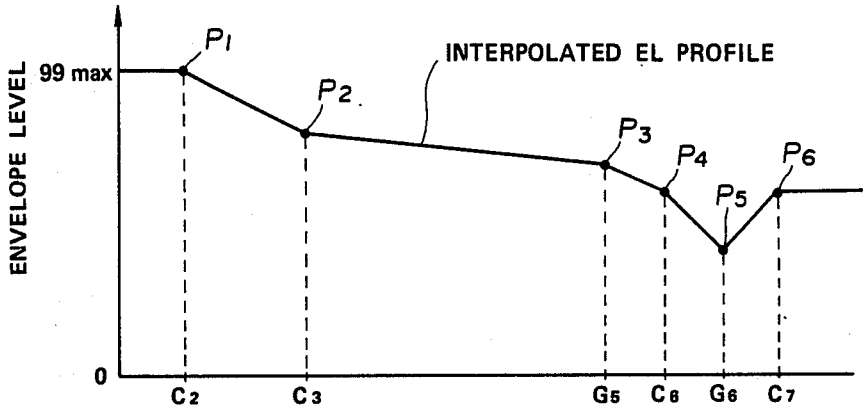
FIG. 5 is a graph showing an example of an envelope level profile as key-scaled by the invention.
Figure 6:
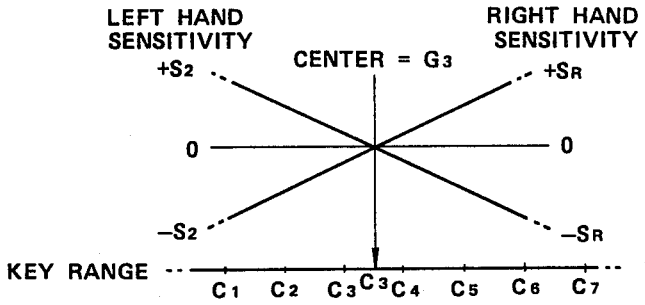
FIG. 6 (PRIOR ART)
FIG. 6 is a graph illustrating a typical prior art key scaling.

Referring to FIG. 5, there is shown a graph of an envelope level profile resulting from the flow in FIG. 4, using the set information shown in FIG. 2. The envelope level for those keys lower than the key C2 at the point P1 is equal to the set level of 99 for the key C2 (see step S2). The envelope level for those keys higher than the key C7 at point P6 is equal to that for the key C7 (step S4). The envelope levels for regions from C2 to C3, from C3 to G5, from G5 to C0 and from C6 to G6 have interpolated values resulting from the formula (1) at step S7. The envelope levels for a region from G6 to C7 have interpolated values resulting from the formula (2) at step S8.

This concludes the description of the preferred embodiment of the invention. However, many modifications and alternations will be obvious to a person having an ordinal skill in the art without departing from the scope of the invention. For example, instead of the linear interpolation, an exponential interpolation may be used. In this case, the key scaling data L(p) for the key code KC is given by:

$$L(p) = \exp[a \times KC + b]$$

wherein:

$$a = \{\ln LP(n+1) - \ln LP(n)\}/\{kp(n+1) - KP(n)\},$$

and:

$$b = \ln LP(n+1) - a \times KP(n+1)$$

wherein KP(n+1) is the set key code higher than and nearest to the key code KC and KP(n) is the set key code lower than and nearest to the key code KC. Accordingly, the scope of the invention should be limited only by the appended claims.

What is claimed:

1. A user-programmable key scaling apparatus for use in an electronic musical instrument and for providing a key scaling response over an entire pitch range, comprising:

play input means for supplying a key number which corresponds to a musical note for musical performance;

tone generator means coupled to said play input means for generating a musical sound whose pitch is designated by the key number supplied from said play input means;

reference data input means for selectively designating at least three different key numbers, and for inputting key scaling data corresponding to said at least three different key numbers as reference data of a key scaling operation;

interpolator means coupled to said reference data input means and to said play input means for computing another key scaling data at a key number designated by said play input means other than said at least three different key numbers according to a musical performance by executing an interpolation calculation based on the reference data supplied from said reference data input means and said key number designated by said play input means; and tone control means coupled to said tone generator means for controlling said tone generator means in accordance with the key scaling data computed by said interpolator means for generating said musical sound having a characteristic determined by said key scaling data corresponding to the key number inputted by said play input means.

2. A key scaling apparatus as recited in claim 1 further comprising display means for displaying the key numbers and their corresponding key scaling data as designated by said reference data input means.

3. A key scaling apparatus as recited in claim 1 wherein said play input means comprises a keyboard.

4. A key scaling apparatus as recited in claim 1 wherein:

said interpolator means comprises means for selecting two key numbers, one being higher than and nearest to the key number supplied from said play input means and the other being lower than and nearest to the key number supplied from said play input means, and means for deriving key scaling data at the key number supplied from said play input means from the two selected key numbers and their corresponding scaling data.

5. A key scaling apparatus as recited in claim 4 wherein said means for deriving key scaling data including means for performing a linear interpolation.

6. A key scaling apparatus as recited in claim 4 wherein said means for deriving key scaling data includes for performing a nonlinear interpolation.

7. A key scaling apparatus as recited in claim 1 wherein the key scaling data computed by said interpolator means is utilized as a subtrahend from which an envelope level is subtracted.

* * * * *